US005921293A

United States Patent [19]

Berger et al.

[11] Patent Number: 5,921,293

[45] Date of Patent: Jul. 13, 1999

[54] DEVICE AND PROCESS FOR FILLING CONTAINERS WITH A LIQUID

[75] Inventors: Jörg Berger, Aachen; Rüdiger Emmerich, Grevenbroich, both of Germany

[73] Assignee: SIG Combibloc GmbH, Linnich, Germany

[21] Appl. No.: 08/860,498

[22] PCT Filed: Aug. 27, 1995

[86] PCT No.: PCT/EP95/03384

§ 371 Date: Sep. 26, 1997

§ 102(e) Date: Sep. 26, 1997

[87] PCT Pub. No.: WO96/06779

PCT Pub. Date: Mar. 7, 1996

[30] Foreign Application Priority Data

Aug. 31, 1994 [DE] Germany ..... 44 30 838

[51] Int. Cl.[6] ..... B65B 3/22

[52] U.S. Cl. ..... 141/276; 141/192; 141/263

[58] Field of Search ..... 141/192, 251, 141/253, 258, 260, 262, 263, 270, 275–278, 148

[56] References Cited

U.S. PATENT DOCUMENTS

| | | | |
|---|---|---|---|
| 2,761,606 | 9/1956 | Pahl et al. | 141/148 |
| 3,543,813 | 12/1970 | Creed | 141/148 |
| 4,305,437 | 12/1981 | Greene | 141/275 |
| 4,401,141 | 8/1983 | Rosen et al. | 141/192 |
| 4,508,148 | 4/1985 | Trechsel et al. | 141/148 |
| 4,557,301 | 12/1985 | Jorss | 141/5 |
| 4,784,193 | 11/1988 | Schmied et al. | 141/198 |
| 4,966,205 | 10/1990 | Tanaka | 141/270 |
| 5,115,841 | 5/1992 | Horino et al. | 141/263 |
| 5,213,140 | 5/1993 | Miscevic et al. | 141/263 |
| 5,335,705 | 8/1994 | Morishita et al. | 141/275 |
| 5,551,493 | 9/1996 | Sonntag et al. | 141/263 |

FOREIGN PATENT DOCUMENTS

| | | |
|---|---|---|
| 6-99937 (A) | 4/1994 | Japan . |
| 681 291 A5 | 2/1993 | Switzerland . |

*Primary Examiner*—J. Casimer Jacyna
*Attorney, Agent, or Firm*—Standley & Gilcrest

[57] ABSTRACT

The invention relates to a device and a process for filling containers closed off at one end, in particular folded carton packings, with a liquid, comprising at least one transport device for moving the container (1), a storage container (5) for holding the liquid, and at least one filling head (2) connected to the storage container (5) and able to be closed off by a filling valve; the said filling head (2) being vertically movable in relation to the container (1) and being able to be lowered into this container (1). Reliable control of the relative movement between container (1) and filling head (2) has been achieved by a simple design, and in this way foaming has been safely eliminated in that a flow meter (8) is arranged between the storage container (5) and the filling valve and in that a control device (9) for converting the impulses of the flow meter (8) into vertical movements of the filling head (2) and/or the container (1) is provided and in that the relative movement between the folded carton packing and the filling head (2) is regulated on the basis of the volume of filling liquid flowing into the container (1); this volume being determined by a flow meter (8).

13 Claims, 2 Drawing Sheets

DEVICE AND PROCESS FOR FILLING CONTAINERS WITH A LIQUID

BACKGROUND OF THE INVENTION

The invention relates to a device and a process for filling containers with a liquid, in particular folded carton packings closed off at one end, comprising at least one transport device for moving the container, a storage container for holding the liquid and at least one filling head connected to the storage container and able to be closed off by a filling valve; the said filling head being vertically movable in relation to the container and being able to be lowered into this container.

Many designs of fast filling machines for filling milk, juice or similarly foaming products are known. In order to avoid a defoaming aggregate in these machines which even without it are quire complex from a design point of view, it is well known for the filling head to be movable in relation of the container in order—at the beginning of, and during, the filling process—to have as small a distance as possible between the filling head and the bottom of the container or the liquid level so as to avoid foaming.

The relative movement between container and filling head either takes place by raising and lowering the container or else by lowering and raising the filling head. In addition, a combination of both variants is possible, even though this makes little sense from a design point of view.

From CH-A-681 291 a device for filling liquids is known in which the filling head is always to be submerged evenly in the liquid. Control of this filling device is quite cumbersome because height measuring takes place by weight measuring cells. To this effect, the signals from the weight measuring cells have to be processed into weight information by an evaluation circuit. The weight information has to be processed in a computer for dose rate control to select the position of the filling valve in relation to the position of the container to be filled.

In order to minimise foaming, the task is to synchronise the mechanical movement of the container or the filling head with the filling level, because for reasons of hygiene the filling head should not be immersed in the liquid already held in the container. This task has already been solved in prior art by synchronising the lifting movement with the movement of a dose rate piston. In the case of older filling machines, synchronisation is by means of cam control; in the case of more modern machine designs, the movements of the container or of the filling head respectively, are carried out by electric servo motors, and movement synchronisation is realised by program control. Such a synchronisation of two movements is technically demanding and in addition, the use of a dose rate piston is expensive and susceptible to wear and malfunction.

SUMMARY OF THE INVENTION

From this starting point it is the object of the present invention to design and further develop the device for filling containers with a liquid or the respective process for this, as mentioned and described in more detail above, to the point where reliable control of the relative movement between container and filling head can be achieved by a simple design, and in this way significantly reduce foaming of the fill product in order to avoid subsequent defoaming.

In a device according to the precharacterizing part of claim 1 this object is met in that a flow meter is arranged between the storage container and the filling valve and in that a control device for converting the impulses of the flow meter into vertical movements of the filling head and/or the container is provided.

In regard to the process according to the invention, the object is met in that the relative movement between the container and the filling head is regulated on the basis of the volume of liquid flowing into the container; this volume being determined by a flow meter.

The device or the process according to the invention does not need the movement of a dose rate piston, because the dose rate flow for the container to be filled is measured by a flow meter and processed to a dose rate volume in a control device.

In a further embodiment of the invention, the flow meter is a magnetically inductive sensor located in the line carrying liquid between the storage container and the filling valve. In this way, the exact volume of through-flow can be achieved reliably without any mechanical contact with the fill liquid.

According to a further development of the invention, the filling head is fixed in place, and below the filling head, a lifting device for raising/lowering the container is provided. As already described, it is however also imaginable that the container about to be filled is fixed in place below the filling head and that a lifting device for lowering/raising the filling head is provided.

Irrespective of the type of design, it is particularly advantageous if the lifting device comprises an axis driven in uniform straight-line motion, and a distance measuring device. This allows control of the lifting device which is simple from a design point of view and yet very reliable.

It is particularly advantageous to combine the flow metering—in particular the inductive flow metering—with the movement of the lifting device, because the movement is realised by an electric servo axis which in turn derives its control function from the impulses, proportional to the flow rate, of the flow meter. In this way there is a direct—and from a design point of view simple realisable—dependence between the movement of the lifting device in relation to the container or the filling head and the actual filling volume, so that expensive synchronisation of two movements can be avoided.

DETAILED DESCRIPTION OF THE INVENTION

Figure 1:
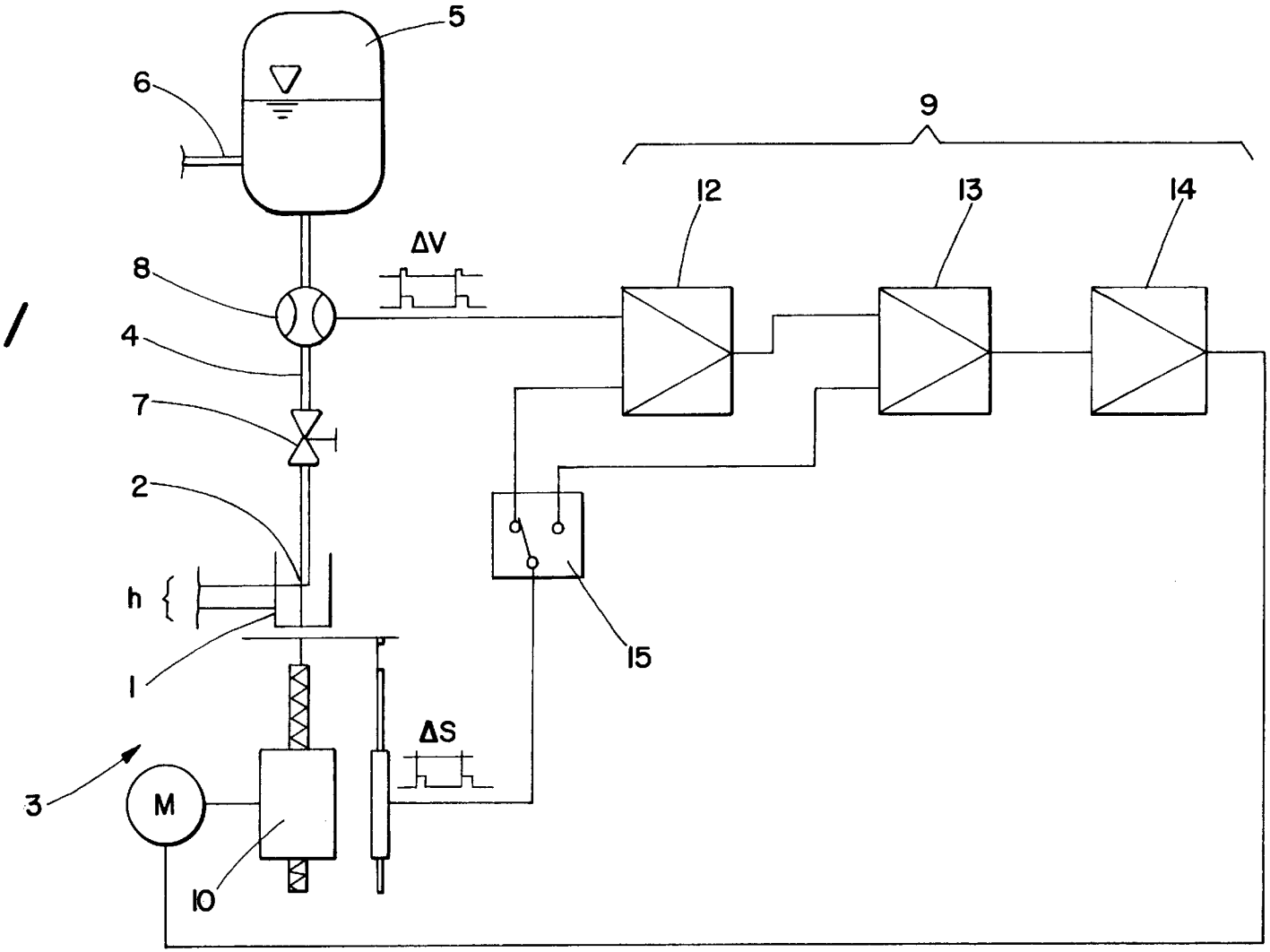
FIG. 1 is a schematic of a preferred embodiment of the invention.

A container 1 which is closed off at one end is arranged on a lifting device 3 below a filling head. In this arrangement, the filling head 2 is supplied by a filling pipe 4 from a storage container 5 which is fed by a supply line 6 only hinted at. Measuring out the filling volume, which depends on the size of the containers, is via a filling valve 7 above the filling head 2.

According to the invention, a flow meter 8 is located between the storage container 5 and the filling valve 7, and a control device 9 serves to convert the impulses of the flow meter 8 into relative vertical movements between container 1 and filling head 2.

In the embodiment shown which so far is the preferred embodiment, the filling head 2 is arranged in a fixed position, and the lifting device 3 serves to raise/lower the container 1. In this way it is possible to reliably maintain a constant distance h between the filling head and the liquid level.

Figure 2:
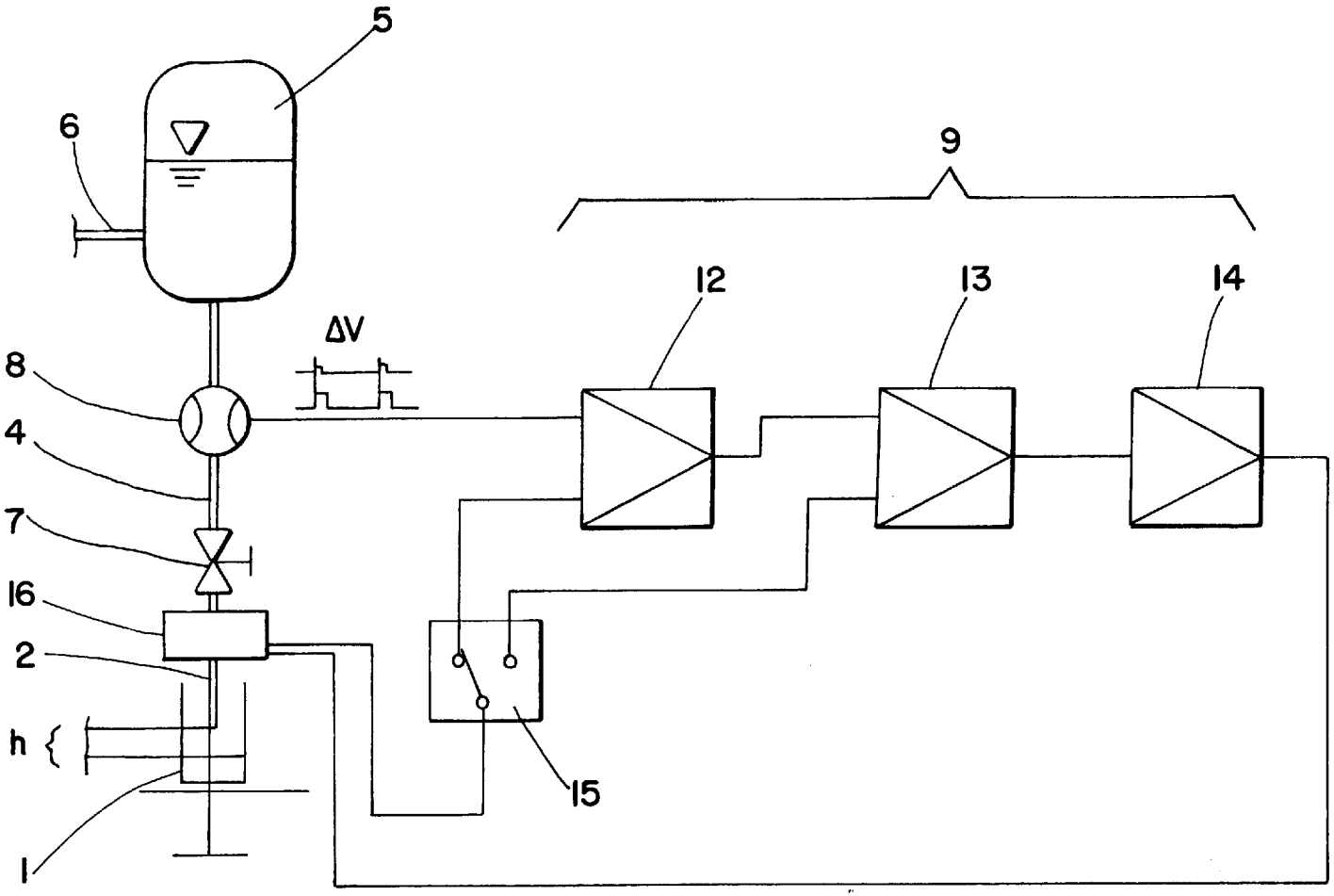
FIG. 2 is a schematic of another embodiment of the invention.

It is however also possible, as seen in FIG. 2, for the container to be arranged in a fixed position below the filling head and for the vertical movement to be carried out by the filling head by the action of the lifting device 16.

In a further embodiment of the invention, the lifting device 3 comprises an axis 10 driven in uniform straight-line motion, and a distance measuring device 11. In addition, it is particularly advantageous if the flow meter 8 is designed as a magnetically inductive sensor.

In the embodiment illustrated, the control device 9 comprises a synchronisation controller 12, a position controller 13 and a speed controller 14. In this arrangement, selection of the synchronisation controller 12 and the position controller 13 is by way of a switch 15 depending on the impulses of the distance measuring device 11.

Direct dependence between the volume of liquid already filled into the container 1 and the position of the lifting device 3 can be mathematically expressed in the formula $\Delta V \times c = \Delta s$, where $\Delta V$ represents the volume of the product measured out into the container and $\Delta s$ represents the travelling distance of the lifting device 3.

We claim:

1. A device for filling a first container closed off at one end with a liquid, comprising:

a storage container for holding the liquid;

at least one filling head connected to the storage container;

a filling valve capable of closing off a flow of liquid to the filling head;

a flow meter positioned between the storage container and the filling valve for measuring the liquid flow into the first container; and a control device for converting the impulses of the flow meter into vertical movements of the filling head, the first container, or both while liquid is flowing from the storage container into the first container to maintain a predetermined distance between the filling head and the liquid level.

2. A device according to claim 1, characterized in that the filling head is fixed in place and that a lifting device for raising/lowering the container located below the filling head is provided.

3. A device according to claim 2, characterized in that the lifting device comprises an axis driven in uniform straight-line motion, and a distance measuring device.

4. A device according to claim 1, characterized in that the container is fixed in place below the filling head and that a lifting device for lowering/raising the filling head is provided.

5. The device of claim 4 characterized in that the lifting device comprises an axis driven in uniform straight-line motion, and a distance measuring device.

6. A device according to claim 1, characterized in that the flow meter is a magnetically inductive sensor.

7. A device according to claim 1, characterized in that the control device comprises a synchronisation controller, a position controller and a speed controller.

8. The device of claim 1 further comprising at least one transport device for moving the container.

9. A process for filling folded carton containers closed off at one end with a liquid, comprising:

providing a filling head connected to a storage container;

providing a filling valve capable of closing off a flow of liquid to the filling head;

providing a flow meter positioned between the storage container and the filling valve for measuring the liquid flow into the carton container; and converting the impulses of the flow meter into vertical movements of the filling head, the carton container, or both while liquid is flowing from the storage container into the carton container to maintain a predetermined distance between the filling head and the liquid level.

10. The process of claim 9 wherein the filling head is moved in response to the impulses of the flow meter.

11. The process of claim 9 wherein the container is moved in response to the impulses of the flow meter.

12. The process of claim 9 wherein both the filling head and the container are moved in response to the impulses of the flow meter.

13. The process of claim 9 wherein the filling head is moved within the container relative to the floor of the container according to the impulse of the flow meter.

* * * * *